United States Patent [19]

Effort

[11] Patent Number: 4,542,830

[45] Date of Patent: Sep. 24, 1985

[54] DISPOSABLE STORAGE RACK FOR CANS OR THE LIKE

[76] Inventor: Wayne A. Effort, 79 College Ave., North Tarrytown, N.Y. 10591

[21] Appl. No.: 573,676

[22] Filed: Jan. 25, 1984

[51] Int. Cl.[4] ..... A47F 7/28

[52] U.S. Cl. ..... 211/49.1; 211/73; 211/59.2; 312/45

[58] Field of Search ..... 211/49 D, 49 R, 72, 211/73; 312/42, 45; 206/45.11, 427, 429, 446

[56] References Cited

U.S. PATENT DOCUMENTS

| | | | |
|---|---|---|---|
| 1,412,547 | 4/1922 | Weymuth | 312/42 X |
| 1,714,469 | 5/1929 | Hoffman | 211/49 D |
| 1,915,341 | 6/1933 | Walker et al. | 312/42 X |
| 2,620,063 | 12/1952 | Stanton | 211/49 R |
| 2,680,556 | 6/1954 | Currie | 206/427 X |
| 2,729,326 | 1/1956 | Stadnyk | 312/42 X |
| 3,002,651 | 10/1961 | Gauld | 312/45 X |
| 3,018,001 | 1/1962 | Combs | 211/49 D |
| 3,115,968 | 12/1963 | Peterson | 211/49 R X |

FOREIGN PATENT DOCUMENTS

| | | | |
|---|---|---|---|
| 1194972 | 11/1959 | France | 312/42 |

*Primary Examiner*—Robert W. Gibson, Jr.
*Attorney, Agent, or Firm*—Ohlandt, John F.

[57] ABSTRACT

A storage rack or container for storing cans and the like on which a deposit is paid; the rack being adapted for ready disposability and being of sturdy construction and easily put together by a consumer of the canned goods; the rack is divided into a number of compartments defined by partitions, and slots are provided at the front for viewing the contents of the rack so as to assure that the rack is full.

7 Claims, 7 Drawing Figures

DISPOSABLE STORAGE RACK FOR CANS OR THE LIKE

BACKGROUND, OBJECTS AND SUMMARY OF THE INVENTION

This invention relates to a storage rack or container and, particularly, to one suitable for storing deposit cans or the like.

The passage of laws in various states which require the payment of a deposit on cans, such as beverage cans and the like, has dictated that a practical means be provided for storing such cans. Unfortunately, the typical consumer often brings in a random collection of cans to a retailer in a typical container such as a bag or box, which involves much uncertainty as to the number of cans contained therein. Consequently, it is a great nuisance for the retailer to determine what is due on the cans, as well as presenting difficulties in storing a great number of cans until they are picked up by a jobber.

Accordingly, a primary object of the present invention is to provide an easy to use storage rack, which is preferably disposable, and which will contain a fixed number of cans or the like.

Another object is to insure that the storage rack or container is easy for the consumer of the canned goods to assemble, or is readily manufacturable for sale as a finished unit or product.

Another feature is to make it convenient for the store owner or retailer to have a ready check on the number of cans involved in the transaction with the consumer.

In fulfillment of the above stated objects, the present invention provides a disposable storage rack having a plurality of partitions providing separate compartments in which cans or the like can be stored. A primary feature resides in the facility for achieving the individual compartment from a blank or flat cardboard member or the like which can be appropriately folded and otherwise put together. An additional feature resides in the provision for self-contained structural support for the rack such that they can be stored together without crushing, even though they have been already assembled as finished units. Such support is provided by reason of suitably configured flaps on the bottom portion of the storage rack, as will be made clear hereinafter.

Other and further objects, advantages and features of the present invention will be understood by reference to the following specification in conjunction with the annexed drawing, wherein like parts have been given like numbers.

DESCRIPTION OF PREFERRED EMBODIMENT

Figure 1:
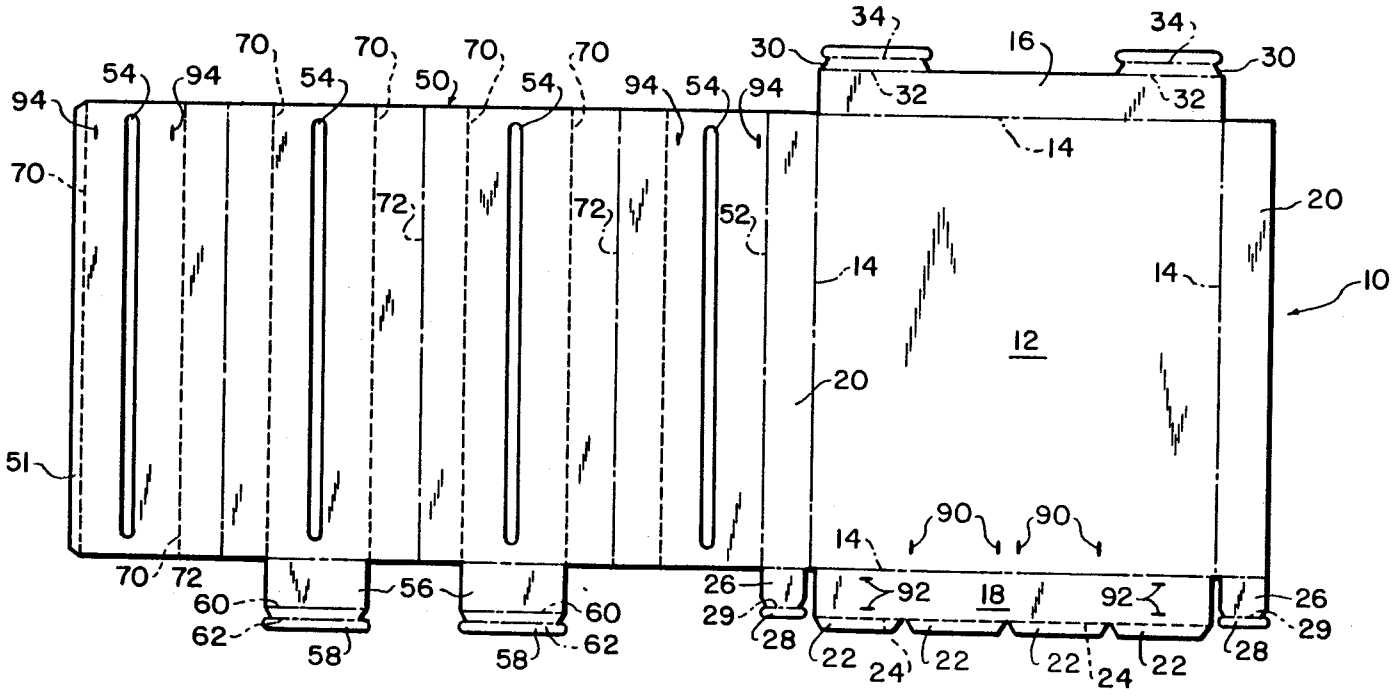
FIG. 1 is an enlarged view in "blank" or "flat form" for the disposable storage rack of the present invention.
Figure 2:
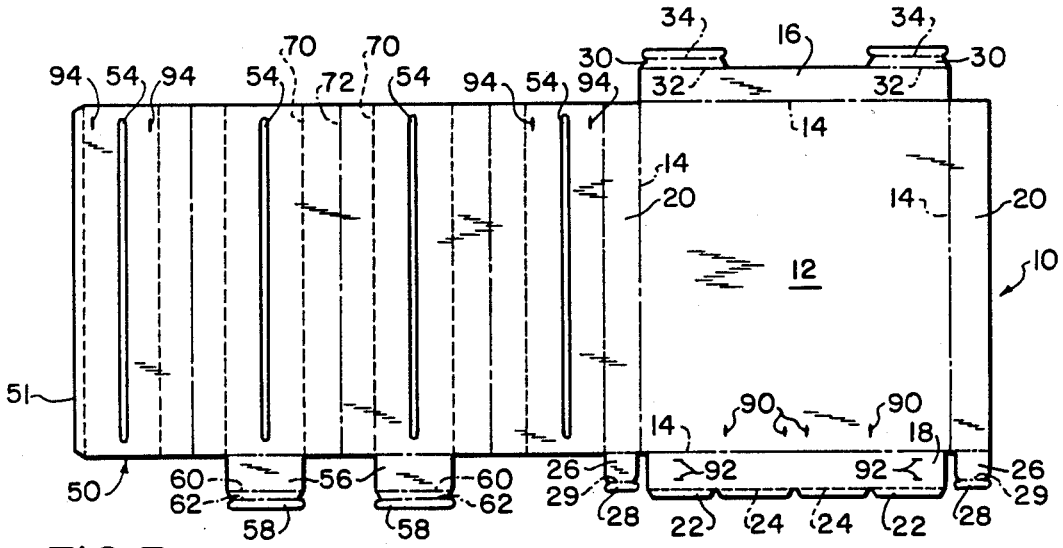
FIG. 2 is another figure substantially identical to FIG. 1 but showing the blank at a reduced scale.

Referring now to the figures of the drawing, and for the moment, particularly to FIGS. 1 and 2, there will be seen a blank or flat form 10 typically made of cardboard, although other materials could also be utilized. A back portion or component 12 is defined within the fold lines 14 forming a rectangle as seen. The top portion 16 and bottom portion 18 are seen extending above and below the upper and lower fold lines 14 respectively. Side portions 20 extend from the right and left fold lines 14.

It will be especially noted that the bottom portion 18 includes flaps 22 that fold along the dotted lines 24 and serve as support members for supporting the section or compartment walls as will be made clear. Each of the side portions includes an extension 26 having a side flap or tab 28 which fold along lines 29. The top portion 16 includes two spaced flaps 30 which fold along the broken lines 32 and 34.

It will be seen that the front portion of the structure is formed or defined by the entire panel or member 50, which extends from the edge of foldable portion 51 at the left end of the blank 10 to the fold line 52 at the right edge. Slotted openings 54 are provided at spaced intervals in the member 50.

Figure 5:
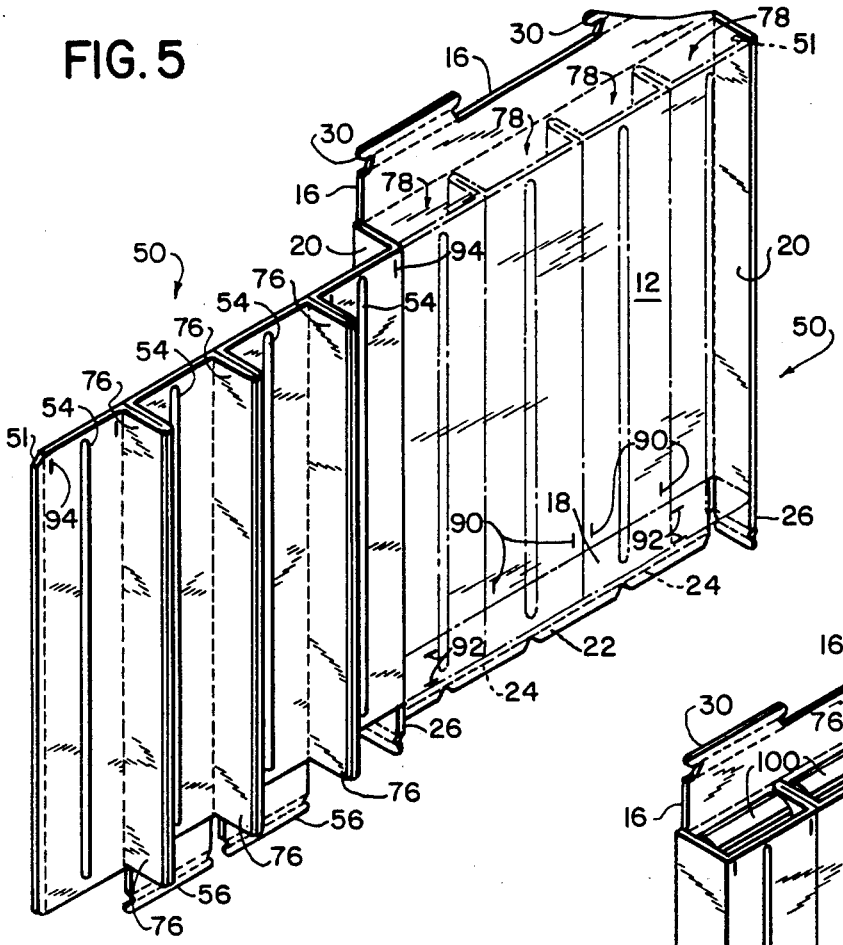
FIG. 5 shows the storage rack partly assembled and illustrating in phantom lines the complete assembly.

Further included as part of the member 50 as extensions thereof are portions 56 appropriately spaced from each other for purposes which will become apparent. These extensions 56 include flaps 58 which are folded along the lines 60 and 62. It will be seen that a series of spaced fold lines are formed in member 50, extending from top to bottom, such lines being designated 70. Intermediate the three pairs of these fold lines are respective scored lines 72 so as to enable formation of partitions 76, seen in FIG. 5, which serve to define a plurality of compartments 78.

Figure 3:
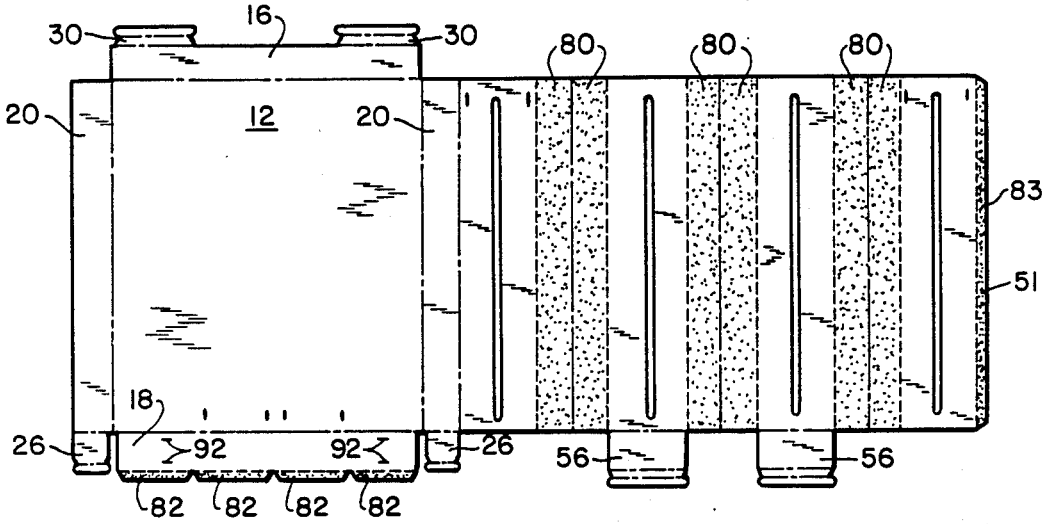
FIG. 3 is a view from the backside of the blank shown in FIG. 2 and illustrating the application of adhesive in selected areas.
Figure 4:
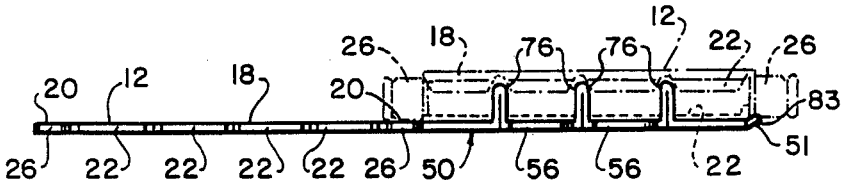
FIG. 4 is a bottom edge view showing the folding of portions of the structure.

In order to form the portions 76, the sections of the blank between the fold line 70 and the scored line 72 are provided with adhesive, seen in FIG. 3 (which illustrates the back side of the blank 10, whereas FIG. 2 illustrates the front side). Adhesive is also provided in the areas 82 on the backside of the flaps 22, as well as in area 83 in the foldable portion 51 (also seen in FIG. 3).

When the disposable storage rack is to be assembled by the consumer or manufacturer, the bottom portion 18 is folded along its fold line 14, thereby becoming perpendicular at the bottom to back portion 12. The flaps 22 are bent upwardly such that their adhesive portions 82 are at the front. The side portions 20 are then suitably folded along their fold lines 14, so that the side portions become perpendicular to the edges of the back portion 12.

The member 50 is bent along the several scored lines 72, and the adhesive-bearing portions 80 are brought together such that the partitions 76 are formed. As can best be appreciated from FIG. 5, the entire member 50 is swung around the fold line 52 and the result is as seen in the phantom showing in FIG. 5. That is to say, the partitions 76 will butt up against the inner surface of the back portion 12 so as to provide the compartments 78.

At this point, the surfaces of the flaps 22 carrying the adhesive 82 are affixed to the lower margin of member 50. Because of the configuration of these flaps, they fit precisely within the compartments 78 and provide firm support for the walls or partitions 76 of these compartments.

The outer bottom extensions 56 of the member 50 are wrapped around the bottom of the storage rack and suitably provided pairs of ears on the outer bottom flaps 58 are pushed, from the back of the rack, through the suitably provided corresponding pairs of openings 90.

The outer side flaps 28 of the side extensions 26 are also provided with pairs of ears that are received in the openings 92 in the bottom portion 18.

Figure 6:
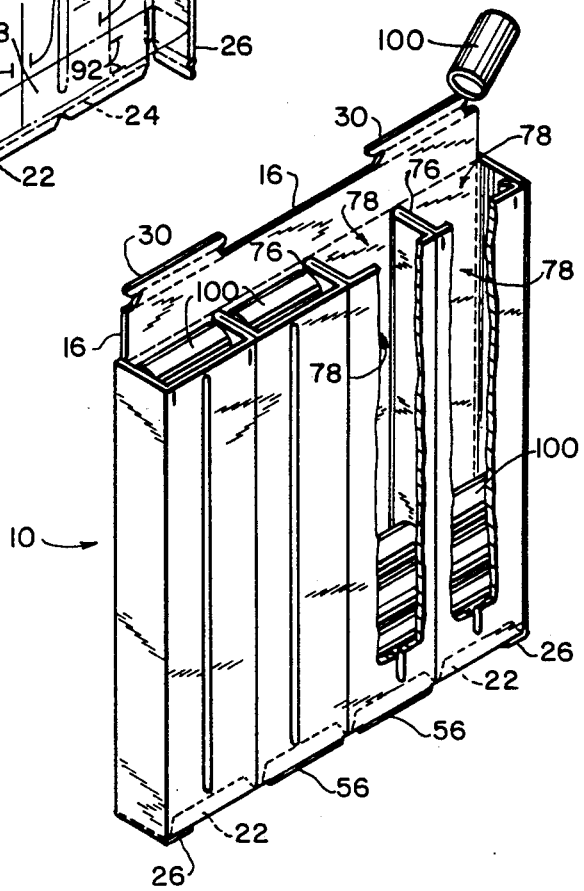
FIG. 6 is a cut away perspective view from the front of the storage rack, showing the rack virtually completely assembled.
Figure 7:
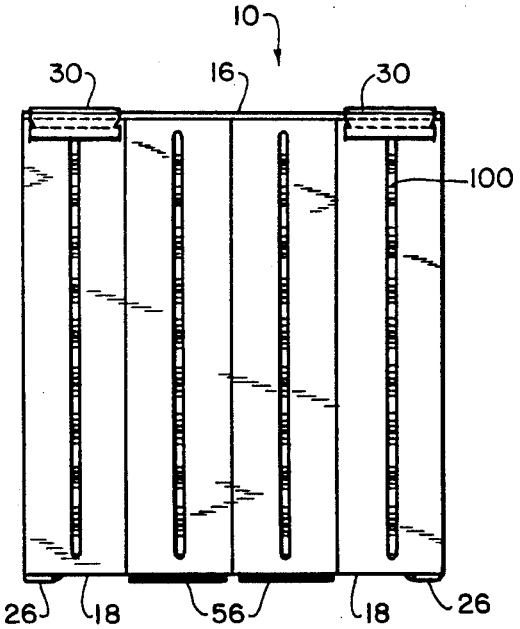
FIG. 7 is a front elevation view showing the flaps of the top section inserted into the top of the front member.

As seen in FIG. 6, the consumer loads the rack, which is typically hung on a wall, by dropping cans 100 into the individual compartments 78. When the rack is completely filled, and is to be brought to the retailer for collection of the deposit due on the cans, the top portion 16 is bent along its fold line 14 and the flaps 30 are bent. Suitably provided pairs of ears are received in corresponding pairs of openings 94.

It will be appreciated by those skilled in the art, that suitable modifications can be made in the storage rack as described. In particular, if desired, a suitable cut-out can be provided in the front of the storage rack for hand gripping in carrying the rack. Also suitable cut-outs can be provided in the top portion for hanging the rack.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

I claim:

1. A disposable storage rack for cans or the like comprising:

a container defined by a blank constituted of cardboard or the like, said blank having panel portions foldable to provide a front wall, rear wall, side walls, and top and bottom walls of said container;

the interior of said container being subdivided by a plurality of spaced partitions extending from said top wall to said bottom wall, thereby to permit storage of cans in each compartment in contiguous relationship from the top to the bottom of said container;

said front wall panel including pairs of adhesive portions extending on either side of a common fold line to a respective fold line, such that the adhesive portions may be brought together in pairs to define each of said partitions;

a plurality of slotted openings extending from adjacent the top of the front wall to the bottom thereof, and extending into the respective compartments;

the top wall being disengageable so that the container is adapted to be hung for storage purposes.

2. A disposable storage rack as defined in claim 1, in which said cans are stored in sidewise contiguous relationship, said compartments being suitably sized therefor.

3. A disposable storage rack as defined in claim 1, in which spaced flaps are provided on the top wall, and including openings provided at the top of said front wall for receiving said flaps, whereby the top of said container is made secure.

4. A device as defined in claim 1, in which a series of spaced flaps are provided on the bottom wall of said blank, said spaced flaps being foldable such that they can be affixed to the front wall for providing support to said partitions.

5. A device as defined in claim 4, in which the back surfaces of said flaps on the bottom portion carry adhesive such that when the flaps are bent upwardly, the flaps can be adhered to said front wall.

6. A device as defined in claim 5, in which spaced extensions from said front wall include flaps which fit into respective spaced openings at the bottom of said rear wall.

7. A device as defined in claim 4, in which extensions of said side walls include flaps, which fit into respective spaced openings in said bottom wall.

* * * * *